US005379470A

United States Patent [19]

Morgan

[11] Patent Number: 5,379,470

[45] Date of Patent: Jan. 10, 1995

[54] DIVAN FOR USE WITH FITTED SHEET

[76] Inventor: Kenneth E. Morgan, 68 Lady Musgrave Road, Kingston 10, Jamaica, WI

[21] Appl. No.: 201,227

[22] Filed: Feb. 24, 1994

[51] Int. Cl.[6] ..... A47C 23/00

[52] U.S. Cl. ..... 5/475; 5/460; 5/400

[58] Field of Search ..... 5/246, 263, 400, 401, 5/402, 475, 460, 403, 406, 407, 200.1

[56] References Cited

U.S. PATENT DOCUMENTS

| | | | |
|---|---|---|---|
| 859,409 | 7/1907 | Radermacher | 5/246 |
| 871,871 | 11/1907 | Hirschman | 5/401 |
| 1,144,123 | 6/1915 | Haas | 5/475 X |
| 3,750,201 | 8/1973 | Usami | 5/263 |
| 3,842,451 | 10/1974 | McCormick | 5/200.1 |
| 3,950,797 | 4/1976 | Bronstein, Jr. | 5/200.1 |
| 4,074,372 | 2/1978 | Schulz, Jr. | 5/200.1 X |

*Primary Examiner*—Michael F. Trettel
*Attorney, Agent, or Firm*—John L. James

[57] ABSTRACT

A divan for use with a fitted bed sheet has a base and mattress constructed as a unitary structure. An operative utility strip is attached to the base, helps support the mattress, and protrudes beyond the base to receive the fitted bed sheet.

8 Claims, 2 Drawing Sheets

DIVAN FOR USE WITH FITTED SHEET

TECHNICAL FIELD OF THE INVENTION

The present invention relates generally to divans, and, more particularly, to an apparatus and method for constructing a divan for use with a standard fitted bed sheet.

BACKGROUND OF THE INVENTION

Conventional divan bedding structures are produced in two separate parts, a base and a mattress which sits on the base. A typical mattress is constructed of innersprings, pads, foam and coir or matting that are enclosed in a fabric or plastic ticking covering. The base is usually made of wood, foam or cardboard with a fabric or plastic ticking. The mattress and base are independent units, and the mattress can accommodate a conventional fitted bed sheet. Because there is a greater demand for mattresses than base units and because mattresses can be used with supports other than divan bases, mattresses are typically constructed and sold separately.

The need for a unitary divan bedding structure has grown over the years for economic and other reasons. Such a unitary structure would provide the economic advantage of lower price while maintaining the quality, comfort, durability, appearance and style of conventional divan bedding structures. Heretofore, development of a unitary structure was hampered by the inability to accommodate conventional fitted bed sheets which are favored for their ease of use and availability at relative low cost. Accordingly, it will be appreciated that it would be highly desirable to have a unitary divan bedding structure usable with conventional fitted sheets while maintaining aesthetic appeal and functional value.

SUMMARY OF THE INVENTION

The present invention is directed to overcoming one or more of the problems set forth above. Briefly summarized, according to one aspect of the invention, a divan comprises a base with a top portion and top surface, an operative utility strip attached to the top portion and having an inside surface adjacent the top surface, an innerspring atop the base and fastened to the base, at least one layer of padding atop the innerspring, and a first covering fastened to the operative utility strip and covering the padding and innerspring.

The base and innerspring with padding and covering form a unitary structure which requires less labor to construct than separate base and mattress components. The operative utility strip adapts the unitary structure to accept a conventional, full-size, fitted bed sheet thereby eliminating the expense of a specially constructed sheet.

According to another aspect of the invention, an operative utility strip adapts a divan to accept a conventional fitted bed sheet where the divan has a base with a top portion and a top surface and is bounded by an outer perimeter, and a mattress assembly atop the base. The operative utility strip comprises a member having a top surface and an inside surface adjacent the top surface along an inner perimeter of the member. The operative utility strip is attachable to the base with the inner perimeter abutting the outer perimeter.

The operative utility strip receives the innerspring, padding and first cover and cooperates with the base to form a unitary structure. The operative utility strip extends beyond the perimeter of the base to provide a protrusion for receiving a fitted bed sheet.

According to another aspect of the invention, a method for constructing a divan comprises forming a base having a top portion and a top surface, forming an operative utility strip having a top surface and an inside surface adjacent the top surface, attaching the operative utility strip to the top portion of the base, fastening an innerspring to the base, positioning at least one layer of padding atop the innerspring, covering the padding and innerspring with a piece of material, and fastening the material to the operative utility strip.

Attaching the operative utility strip to the top portion of the base and fastening the innerspring to the base ties the strip, base and innerspring together in a unitary structure. Positioning padding on the innerspring provides softness for comfort. Covering the padding and innerspring with a piece of material increases aesthetic appeal. Fastening the material to the operative utility strip which extends beyond the perimeter of the base facilitates use of a fined bed sheet.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
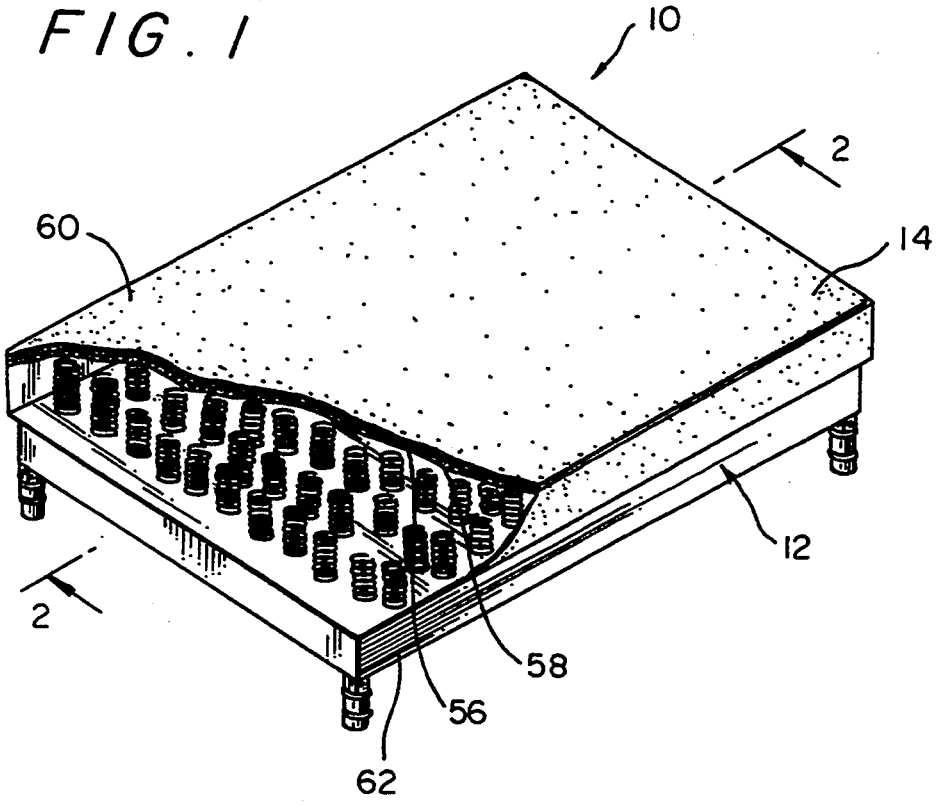
FIG. 1 is a perspective view of a divan incorporating a unitary base and mattress according to the present invention.
Figure 2:
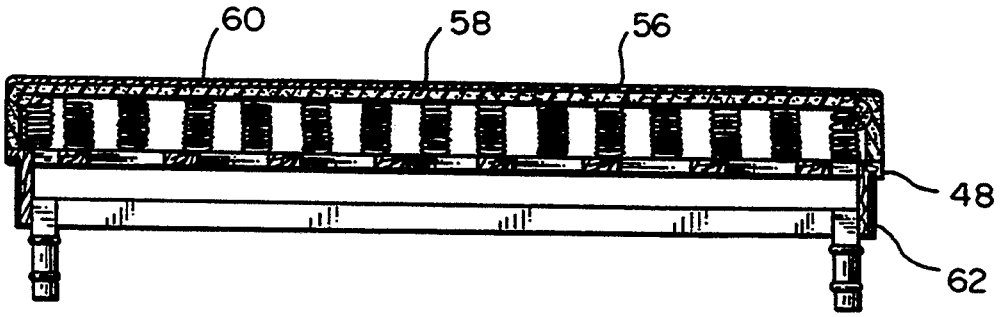
FIG. 2 is a longitudinal sectional view taken along line II—II of FIG. 1.
Figure 3:
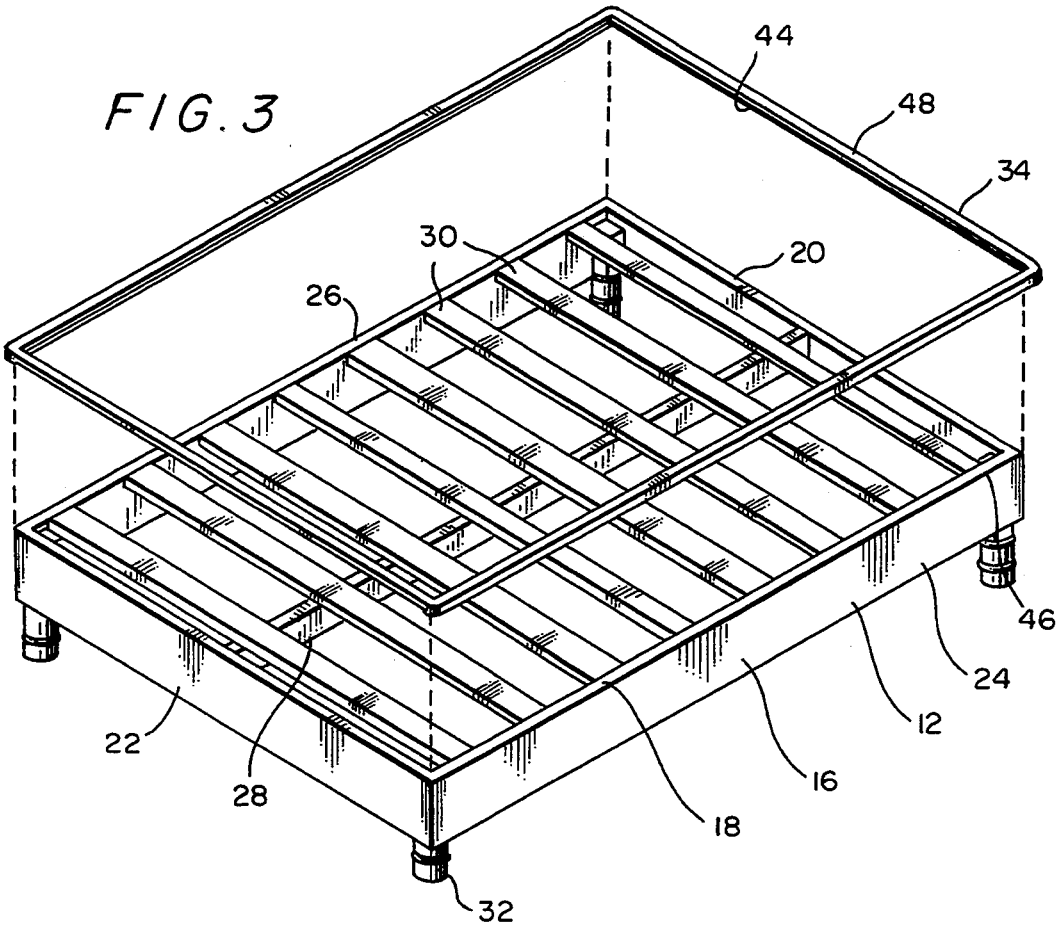
FIG. 3 is an exploded view of the base of the divan of FIG. 1 illustrating the operative utility strip.

Referring to FIGS. 1–3, a divan 10 has a base frame portion 12 and a mattress portion 14 atop the base 12. The base 12 has a top portion 16 with a top surface 18 on the top portion 16. The base 12 has parallel head and foot frame members 20, 22, parallel side frame members 24, 26, and a center frame member 28 that is parallel to the side members 24, 26 and extends between and is perpendicular to the head and foot members 20, 22. The center frame member 28 is preferably positioned equidistant between the side frame members 24. 26. While only one center frame member 28 is illustrated, there may be more than one center frame member to provide the structural support and integrity required for the intended use of the divan 10. There are a series of lateral frame members 30 that are parallel to the head and foot frame members 20, 22 and perpendicular to the center frame member 28.

Legs 32 support the base 12 and are attached to inside corners of the base 12 formed by joining of the head and foot frame members 20, 22 with the side frame members 24, 26. Where extra support is required, a fifth leg may be attached to the center frame member 28. While the corners of the frame 12 are shown square, they may be rounded or have a configuration considered more aesthetically appealing. Similarly, the legs 32 may be carved or turned on a lathe for aesthetic appeal.

An operative utility strip (OPS) 34 has a top surface 36 and an inside surface 38 that is adjacent the top surface 36. The OPS is attached to the top portion 16 of the base 12. As illustrated, the legs 32 support the base 12 so that the top surface 18 is 12 inches higher than the bottom of the legs 32 which rest on the floor. This is a standard height which may be varied according to the intended use of the divan 10.

Figure 4:
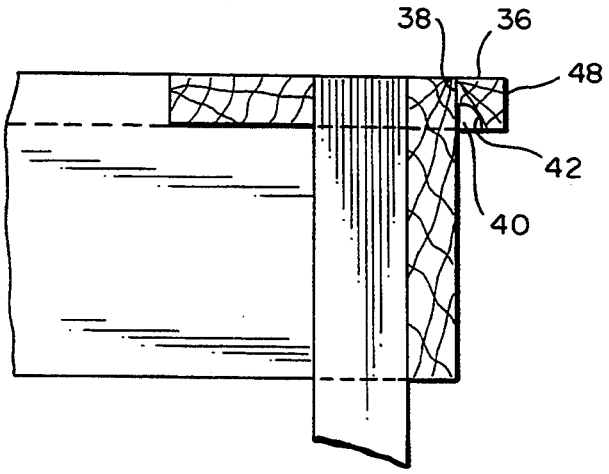
FIG. 4 is a somewhat enlarged sectional view of a corner of the base with the operative utility strip installed.

Referring now to FIG. 4, the OPS 34 and top portion 16 of the base 12 define a groove 40 about the base 12. The OPS 34 has a curved surface 42 adjacent the inside surface 38 with the curved surface 42 and top portion 16 of the base 12 defining the ,groove 40 between the OPS 34 and the base 12. As illustrated in FIGS. 3 and 4, the OPS 34 has an inner perimeter 44 and an outer perimeter 46, and is positioned so that the inner perimeter 44 of the OPS 34 is adjacent the outer perimeter 48 of the base 12. By this construction, the base 12 fits inside the OPS 34 so that the inner perimeter 44 of the OPS 34 is adjacent the outer perimeter 48 of the base 12 for attaching the OPS 34 to the base 12. Preferably, the top surface 36 of the OPS 34 is flush with the top surface 18 of the top portion 16 of the base 12.

Figure 5:
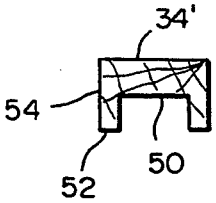
FIG. 5 is a sectional view similar to FIG. 4, but illustrating another embodiment.

FIG. 5 illustrates another embodiment of the OPS 34' that has a groove 50 formed in a groove surface 52 that is adjacent an inside surface 54 which forms the inner perimeter of the OPS 34'.

Referring now to FIGS. 1 and 2, an innerspring assembly 56 is positioned atop the base 12 and fastened to the base 12 with staples or other fasteners. The innerspring 56 is also fastened to the center frame member 28. At least one layer of padding 58 is positioned on top of the innerspring 56, and a first covering 60 is positioned over the padding 58 and innerspring 56 and fastened to the OPS 34. A second covering 62 may be attached to the head and foot frame members 20, 22 and the parallel side frame members 24, 26 for aesthetic appeal, or these frame members may be painted or otherwise decorated for aesthetic appeal. Of course, the mattress portion is built up using mattress tape, foam sheets, pads sheets, and other materials as is well known in the art.

For a standard sized divan, the base frame is preferably constructed of wooden members to a standard height of 12 inches above floor level with overall dimensions of about 53.5 inches by 74.5 inches. With the OPS installed, this corresponds to a finished size of about 54 inches by 75 inches which is the finished size of the full sized mattress to be constructed The OPS may be constructed of wood, metal, plastic or other strong, durable material, and may vary from about 0.375 inches to 5 inches in width and from about 0.25 inches to 3 inches in thickness. Staples or other fasteners attach the operative utility strip to fit flush with the top of, and run the exact perimeter of, the base frame. The OPS has grooved internal comers and my fit directly on the base or may be extended beyond the base to be used as a platform on which to sit the innerspring for production. The OPS is grooved at the bottom and fitted with staples, nails, adhesive or other fasteners. The OPS is curved at all four comers of the base frame to match the curve around the comers of a finished mattress.

The innerspring is fitted to the top of and in the center of the base frame which is laid horizontally and stapled down firmly to avoid movement. The top of the innerspring is then upholstered with the materials required to make a mattress. The four comers of the mattress are shaped to match the corners of the OPS.

Where upholstered frame sides are desired, the mattress covering or ticking is made with a side piece deep enough to enclose the upholstered innerspring and base frame sides together. It is pulled over and pinned firmly to the bottom of the OPS automatically covering the sides of the innerspring while creating the necessary allowance for a fitted sheet. Side fixation is completed by stapling the remainder of the side piece hanging down to the bottom edges of the frame. The base frame is then covered with a separate piece of fabric to complete the upholstered all-in-one divan bedding structure. Alternatively, side fixation is completed by terminating the covering at the bottom of the OPS leaving the wood of the frame exposed and ready for paint or other finish.

It can now be appreciated that there has been presented an operative utility strip which adapts a divan to accept a conventional fitted bed sheet. The operative utility strip receives the innerspring, padding and first cover and cooperates with the base to form a unitary structure. The operative utility strip extends beyond the perimeter of the base to provide a protrusion for receiving a fitted bed sheet.

It can also be appreciated that there has been presented a method for constructing a divan which includes forming a base having a top portion and a top surface, forming an operative utility strip having a top surface and an inside surface adjacent the top surface, attaching the operative utility strip to the top portion of the base, fastening an innerspring to the base, positioning at least one layer of padding atop the innerspring, covering the padding and innerspring with a piece of material, and fastening the material to the operative utility strip. Attaching the operative utility strip to the top portion of the base and fastening the innerspring to the base ties the strip, base and innerspring together in a unitary structure. Positioning padding on the innerspring provides softness for comfort. Covering the padding and innerspring with a piece of material increases aesthetic appeal. Fastening the material to the operative utility strip which extends beyond the perimeter of the base facilitates use of a fitted bed sheet.

While the invention has been described with particular reference to the preferred embodiments, it will be understood by those skilled in the art that various changes may be made and equivalents may be substituted for elements of the preferred embodiment without departing from invention. For example, the OPS may directly overlay the base frame so that the outer perimeters are coincident when viewed from the top, or the OPS may exist inside the outer perimeter of the base. Such configurations are possible as long as the groove is accessible and oriented to receive the edge of the fitted sheet. The OPS may even be incorporated into the base or exist on a platform on the base. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled the art. It is accordingly intended that the claims shall cover all such modifications and applications as do not depart from the true spirit and scope of the invention. The combination of the mattress and the base divan into one single unit will provide a more economical and efficient bedding structure with resultant saving to the consumer. The operative utility strip anchors the bottom edge of a conventional fitted bed sheet so that the unitary structure can accept a fitted sheet. This provides convenience and eliminate the expense of specially made sheets.

What is claimed is:

1. A divan, comprising:

a base having a top portion and a top surface on said top portion of said base;

an operative utility strip having a top surface and an inside surface adjacent said top surface, said operative utility strip being attached to said top portion of said base, said operative utility strip has a groove surface adjacent said inside surface, said groove surface having a groove therein;

an innerspring atop said base and fastened to said base;

at least one layer of padding atop said innerspring; and a first covering fastened to said operative utility strip and covering said padding and innerspring.

2. A divan, as set forth in claim 1, wherein said base has a parallel head and foot frame members, parallel side frame members and center frame member parallel to said side members and extending between said head and foot members.

3. A divan, as set forth in claim 2, wherein said innerspring is fastened to said center frame member.

4. A divan, as set forth in claim 2, including a second covering attached to said head, foot and side frame members.

5. A divan, as set forth in claim 1, wherein said base has an outer perimeter and wherein said operative utility strip has inner and outer perimeters, said base being positioned inside said operative utility strip so that said inner perimeter of said operative utility strip is adjacent said outer perimeter of said base.

6. A divan, as set forth in claim 1, wherein said top surface of said operative utility strip is flush with said top surface of said top portion of said base.

7. An operative utility strip for adapting a divan to accept a conventional fitted sheet, said divan having a base with a top portion and a top surface and bounded by an outer perimeter, a mattress assembly atop said base, said operative utility strip comprising:

a member having a top surface and an inside surface adjacent said top surface along an inner perimeter of said member, said operative utility strip being attachable to said base with said inner perimeter abutting said outer perimeter, said member has a curved surface adjacent said inside surface, said curved surface and said top portion of said base defining a groove between said operative utility strip and said base.

8. An operative utility strip for adapting a divan to accept a conventional fitted sheet, said divan having a base with a top portion and a top surface and bounded by an outer perimeter, a mattress assembly atop said base, said operative utility strip comprising:

a member having a top surface and an inside surface adjacent said top surface along an inner perimeter of said member, said operative utility strip being attachable to said base with said inner perimeter abutting said outer perimeter, said operative utility strip has a groove surface adjacent said inside surface, said groove surface having a groove therein.

* * * * *